US011039971B2

(12) United States Patent
Berry et al.

(10) Patent No.: US 11,039,971 B2
(45) Date of Patent: Jun. 22, 2021

(54) TANDEM PIVOT MOUNT FOR DENTAL PATIENT CHAIR

(71) Applicant: A-dec, Inc., Newberg, OR (US)

(72) Inventors: Patrick W. Berry, Vancouver, WA (US); Dudley Keen, Sherwood, OR (US)

(73) Assignee: A-dec, Inc., Newberg, OR (US)

( * ) Notice: Subject to any disclaimer, the term of this patent is extended or adjusted under 35 U.S.C. 154(b) by 92 days.

(21) Appl. No.: 16/386,199

(22) Filed: Apr. 16, 2019

(65) Prior Publication Data

US 2020/0330311 A1 Oct. 22, 2020

(51) Int. Cl.

| | |
|---|---|
| ***A61G 15/02*** | (2006.01) |
| ***A61G 15/10*** | (2006.01) |
| *A61G 15/14* | (2006.01) |

(52) U.S. Cl.
CPC ..... *A61G 15/02* (2013.01); *A61G 15/10* (2013.01); *A61G 15/14* (2013.01)

(58) Field of Classification Search
CPC ..... A61G 15/02; A61G 15/10
See application file for complete search history.

(56) References Cited

U.S. PATENT DOCUMENTS

| | | | | |
|---|---|---|---|---|
| 3,771,226 | A | 11/1973 | Lieb et al. | |
| 3,986,263 | A | 10/1976 | Borgelt et al. | |
| 4,427,382 | A | 1/1984 | Hoffmeister et al. | |
| 7,195,219 | B2 | 3/2007 | Irwin et al. | |
| 8,360,058 | B2 * | 1/2013 | Ahearn | A61M 16/1075 128/203.28 |
| 8,955,905 | B2 * | 2/2015 | Boenigk | A47C 7/70 297/173 |

FOREIGN PATENT DOCUMENTS

| | | | |
|---|---|---|---|
| EP | 1541110 | 6/2005 | |
| FR | 2233977 A1 * | 1/1975 | A61G 15/16 |

OTHER PUBLICATIONS

Dentistry Today, "Ambidextrous Dental Chair Package Designed for Ergonomics" https://www.dentistrytoday.com/products/product-highlights/item/3999-ambidextrous-dental-chair-package-designed-for-ergonomics, (Nov. 1, 2018).

Flight Dental Systems, "A12 Operatory System," https://flightdentalsystems.com/product/a12-operatory-system/, (downloaded Mar. 28, 2019).

Forest Dental Catalog 2016, Chair Mount Packages, https://pdf.medicalexpo.com/pdf/forest-dental/fd-catalog-2016/72232-188167-_17.html, p. 17 (downloaded Oct. 7, 2019).

* cited by examiner

*Primary Examiner* — Anthony D Barfield
(74) *Attorney, Agent, or Firm* — Klarquist Sparkman, LLP

(57) ABSTRACT

A dental chair assembly comprises a base, a support, a first pivot mount and a second pivot mount. The support is configured to support a chair seat defined to extend in a forward direction and a chair back positioned rearward of the chair seat. The support has a forward side, an opposite rearward side and a longitudinal axis extending through the forward and rearward sides. The first pivot mount is positioned along the longitudinal axis forward of the rear side of the support and configured to support at least one movable arm. The first pivot mount defines a first upright pivot axis. The second pivot mount is positioned along the longitudinal axis and spaced forwardly from the first pivot mount. The second pivot mount is configured to support at least one movable arm and defines a second upright pivot axis parallel to the first upright pivot axis.

20 Claims, 7 Drawing Sheets

TANDEM PIVOT MOUNT FOR DENTAL PATIENT CHAIR

BACKGROUND

This application relates to a dental chair assembly, and specifically to arrangements for positioning various dental equipment close to the dental patient chair for the practitioner to use during treatment.

In a typical dental operatory setting, dental equipment may include a delivery system (from which instruments that use water, pressurized air, suction, electrical power, data, etc. are accessed), as well as equipment of other types, including lights, monitors, other types of instruments, etc., that can be supported in desired positions by one or more movable arms mounted to the dental chair assembly or its surroundings (e.g., a cabinet, wall, floor or ceiling).

Some small operatories do not provide sufficient space, however, to fully utilize currently available arrangements of movable arms. Also, some currently available arrangements of movable arms do not provide equal ranges of motion on both sides of the chair, and thus are less flexible for being repositioned between uses by left-handed and right-handed practitioners. In some cases, currently available arm arrangements do not allow for equipment to be positioned at some desired locations because of limitations in range and/or interference between components of the arrangements.

SUMMARY

Described below are implementations of mounting arrangements for movable arms in a dental chair assembly.

According to a first implementation, a dental chair assembly comprises a base, a support, a first pivot mount and a second pivot mount. The support is movably coupled to the base and configured to support a chair seat defined to extend in a forward direction and a chair back positioned rearward of the chair seat. The support has a forward side, an opposite rearward side and a longitudinal axis extending through the forward and rearward sides. The first pivot mount is positioned along the longitudinal axis forward of the rear side of the support and configured to support at least one movable arm. The first pivot mount defines a first upright pivot axis. The second pivot mount is positioned along the longitudinal axis and spaced forwardly from the first pivot mount. The second pivot mount is configured to support at least one movable arm and define a second upright pivot axis parallel to the first upright pivot axis.

The first pivot mount can be defined along a pivot mount section extending forwardly from a main body of the support. The first upright pivot axis and the second upright pivot axis can intersect the chair seat.

The dental chair assembly can include a first movable arm mounted to the first pivot mount and a second movable arm mounted to the second pivot mount, and the first movable arm can be positioned to swing through an arc at a level below the second movable arm. The dental chair assembly can comprise a pivot mount extension member coupled to the support. The second pivot mount can be defined along the pivot mount extension member. In one implementation, the pivot mount extension member is coupled to an upper side of the first pivot mount. In one implementation, the pivot mount extension member is coupled to the pivot mount section of the support with fasteners.

In one implementation, the second pivot mount is configured to be coupled to the pivot extension member from below.

In one implementation, at least one of the first pivot mount and the second pivot mount comprises a hollow construction defining an internal umbilical passage through which one or more umbilicals can be routed.

In one implementation, the first movable arm is configured to swing radially outward relative to the second movable arm. The first movable arm can be configured to have a longer radius than the second movable arm.

In one implementation, the second movable arm is configured to support a dental light. In one implementation, the first movable arm is configured to support at least a delivery system.

The support can comprise a movement device coupled to the base and operable to raise and lower the support.

The first pivot mount can have a first pivot mount opening and the second pivot mount can have a second pivot mount opening, and the first pivot mount opening and the second pivot mount opening can be positioned at a substantially common level.

In one implementation, a pivot mount extension member is coupled to the support and defines first and second openings for the first and second pivot mounts.

The first and second movable arms can each have a length greater than the distances separating the first pivot axis from a distal end of the chair seat and from the second pivot axis and the distal end of the chair seat, respectively.

The foregoing and other objects, features and advantages will become more apparent from the following detailed description, which proceeds with reference to the accompanying figures.

DETAILED DESCRIPTION

Described below are implementations of a tandem pivot mount for a dental chair assembly and a dental chair assembly having a tandem pivot mount (or hub).

Figure 1:
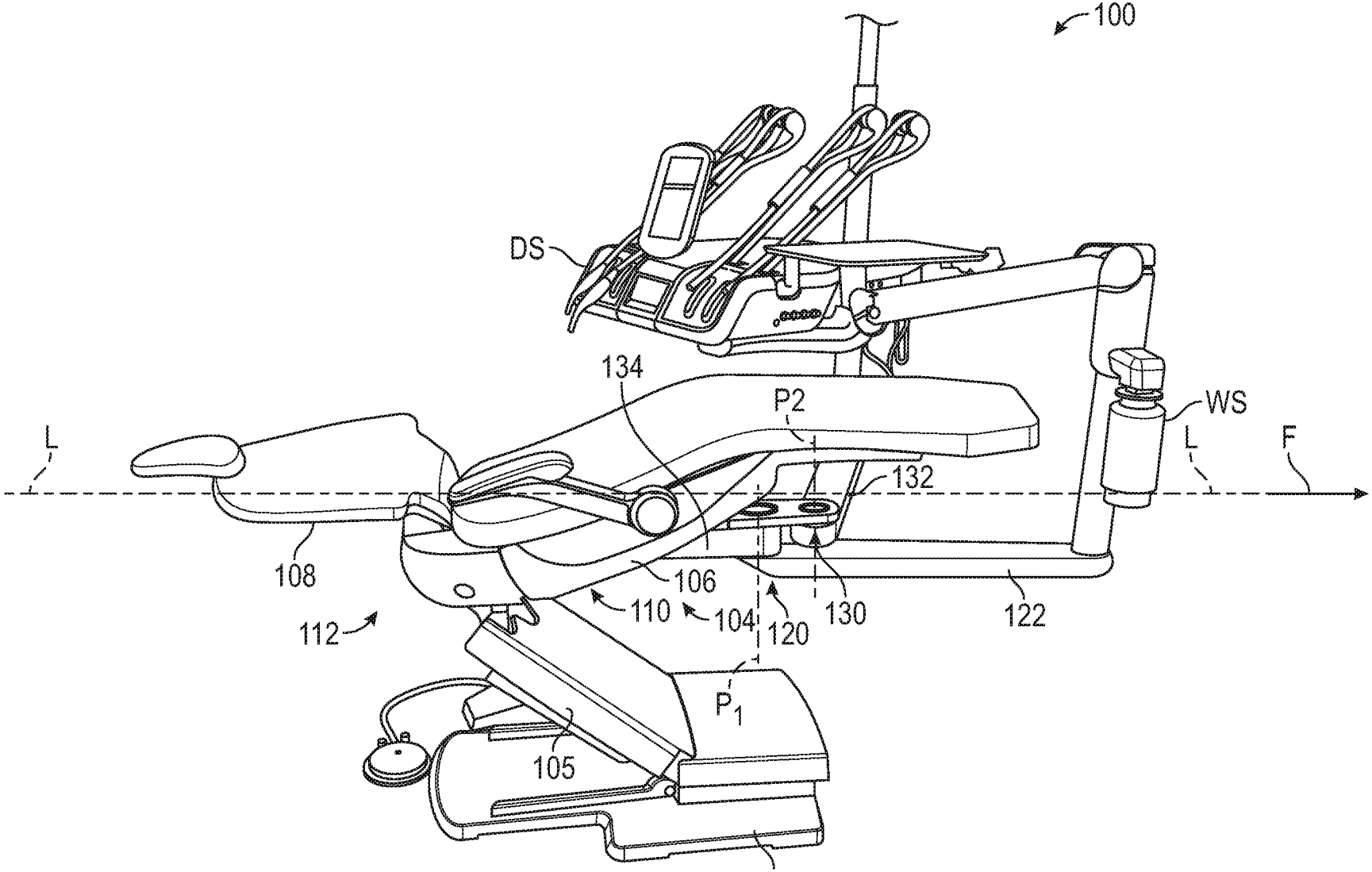
FIG. 1 is a perspective view of a dental chair assembly showing a dental chair back in a reclined position and showing first and second movable arms mounted at a forward location and having separate pivot axes.

Referring to FIG. 1, a dental chair assembly 100 has a base 102, a support 104 movable relative to the base, and a chair seat 106 and a chair back 108 that are each coupled to the support 104. The dental chair assembly 100, which is sometimes also referred to as a patient chair or a treatment chair, is designed to accommodate a patient (not shown)

comfortably, while allowing the patient to be positioned as needed relative to a dentist or other practitioner(s) during treatment. For example, the chair back 108 can be positioned in a fully reclined position as shown, and the movable support 104 can be raised or lowered to achieve a desired height above the base 102 to permit the practitioner, who is typically seated in a stool, to access the patient's oral cavity effectively.

The base 102 is typically positioned on the floor of the operatory. The support 104 is movable by a movement mechanism 105, such as a hydraulic lift arm or other similar type of movement device capable of raising and lowering the level of the support 104 relative to the base 102. The support 104 may also pivot through an angular range as it raised and lowered.

A longitudinal axis L is defined to extend along the centerline of the chair seat 106 and the chair back 108, with a forward direction F defined as extending in the direction of the chair seat 106. The support 104 has a forward side or end 110, and an opposite rearward side or end 112.

Forward of the rearward end 112, there is a first pivot mount 120 positioned on the longitudinal axis L that pivotably supports a first movable arm 122. The first movable arm 122 can pivot or rotate (i.e., to the left or to the right) with respect to the first pivot mount 120 about a first upright pivot axis $P_1$. There is also a second pivot mount 130 positioned on the longitudinal axis L and forward of the first pivot mount 120 that supports a second movable arm 132. The second movable arm 132 can pivot or rotate with respect to the second pivot mount 130 about a second upright pivot axis $P_2$. The first and second pivot mounts 120, 130 can spaced close to each other along the longitudinal axis L as shown (e.g., even side by side), but are spaced apart from each other such that each defines a separate upright pivot axis $P_1$, $P_2$, respectively, to achieve various advantages as described herein. The arrangement of the first and second pivot mounts 120, 130 can be described as "a tandem pivot mount."

Among other advantages described herein, because the first pivot mount 120 and the second pivot mount 130 are each positioned on the longitudinal axis, the first and second movable arms 122, 132, respectively, can each be positioned through left-side and right-side angular ranges that are equal to each other (assuming that there are no interfering objects, such as walls, cabinets and/or other equipment). In this way, the dental chair assembly 100 with the tandem pivot mount supports uses where the movable anus need to be repositioned for use by left-handed and right-handed practitioners. This is an advantage, particularly in settings where left-handed and right-handed practitioners frequently share use of the same dental chair assembly 100.

Figure 2:
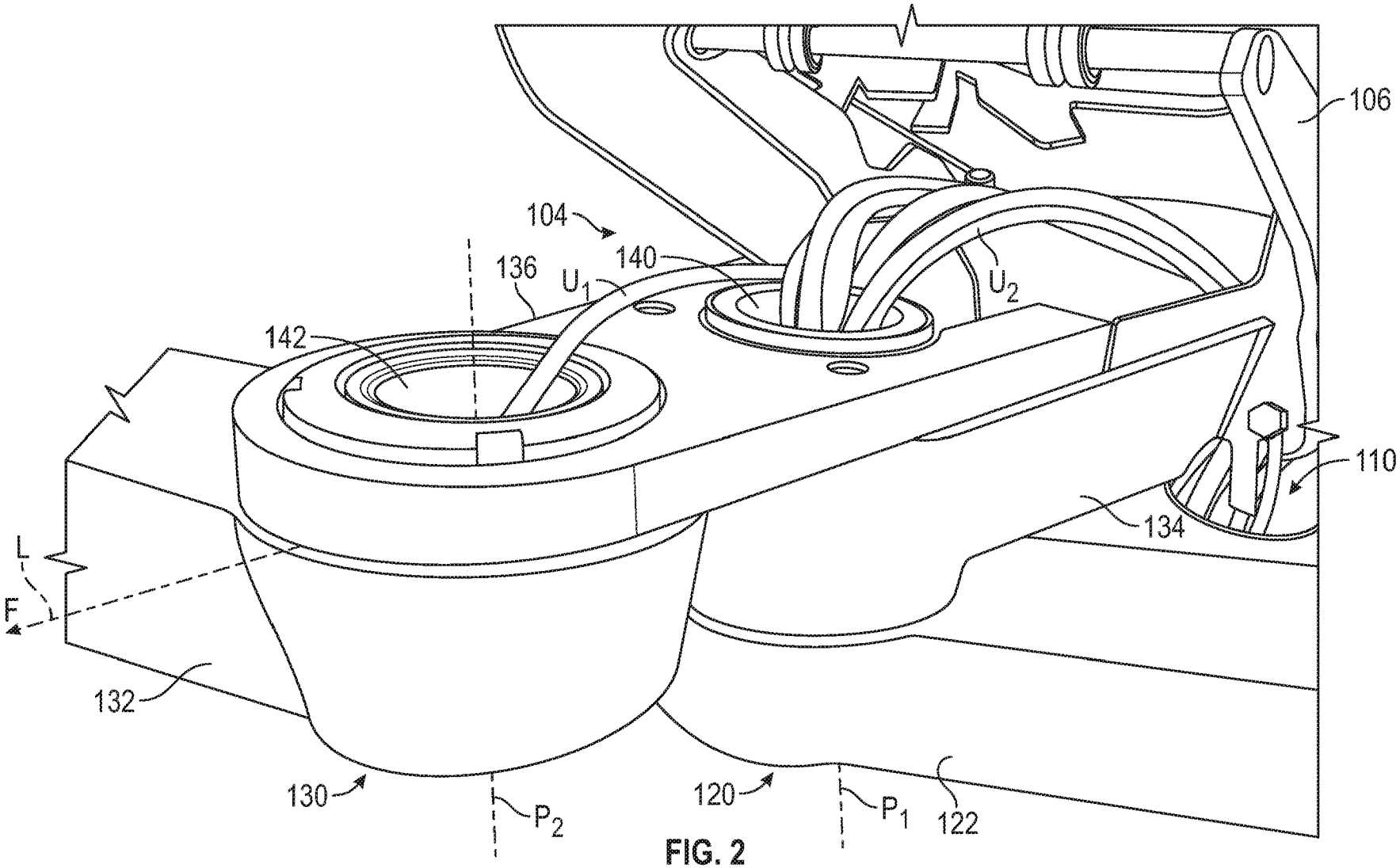
FIG. 2 is a magnified perspective view of a portion of a pivot mount of FIG. 1 for the movable arms.

As described, the first and second movable arms 122, 132 are positioned forwardly, i.e., forward of the rear end 112 of the support 104, and typically forward of an axis about which the chair back 108 is pivotal*. In the illustrated implementation, as shown in FIG. 2, the support 104 has a pivot mount section 134 extending forwardly in which the first pivot mount 120 is defined. In other implementations, the pivot mount 120 could be provided at the forward location relative to the chair as described to achieve the same placement of the pivot axis $P_1$, but coupled to structure other than the chair.

In the illustrated implementation, the first movable arm 122 is pivotably mounted at a lower side of the first pivot mount 120. Thus, the first movable arm pivots (or rotates or swings) in a plane at a level below the pivot mount section 134. In an alternative arrangement (not shown), the first movable arm 122 could be pivotably mounted above a supporting member.

The pivot mount section 134 can also be configured to provide the second pivot mount 130. In the illustrated implementation, the pivot mount section 134 can have a pivot mount extension member 136 that extends forwardly and defines the second pivot mount 130. The pivot mount extension member 136 can be formed as a plate and coupled to an upper surface of the pivot mount section 134, e.g., with threaded fasteners or another suitable arrangement. The second movable arm 132 can be coupled to the pivot mount extension member 136 from below to pivot in a plane below the pivot mount extension member 136. In the illustrated implementation, the second movable arm is positioned to pivot in approximately the same plane as the pivot mount section 134.

Figure 8:
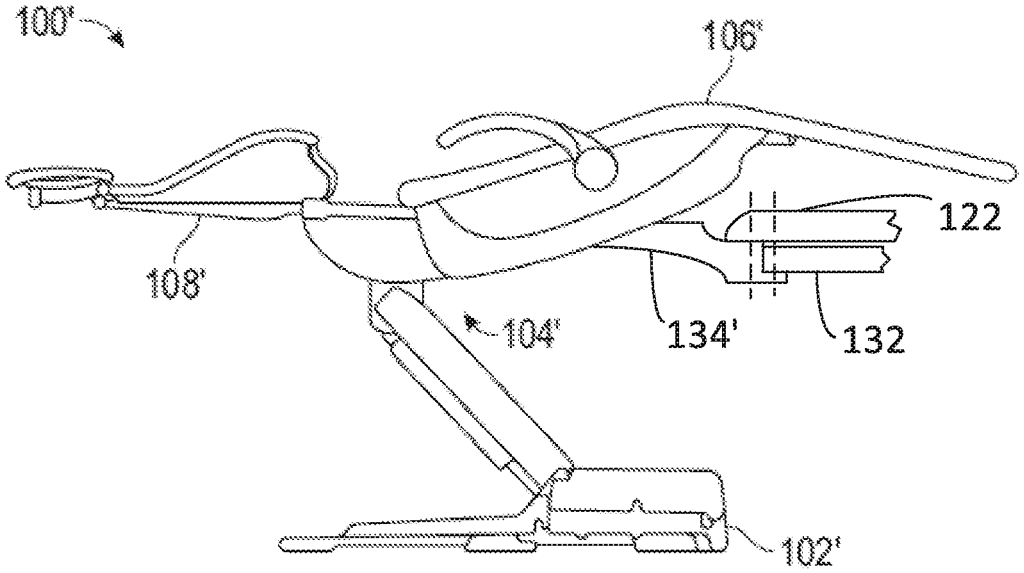
FIG. 8 is a side elevation view similar to FIG. 7, except showing alternative arrangements for the movable arms and an alternative pivot mount section.

In another implementation, the pivot mount section 134 projects forwardly and defines the position of the first pivot axis $P_1$ at the same location as described above, but the first movable arm 122 is coupled vertically above the pivot mount section 134. The second movable arm 132 can then be positioned for rotation in a plane at a level below the first movable arm 122 (see, e.g., FIG. 8). The pivot mount extension member 136 can be positioned to extend from a lower side of the pivot mount section 134, or a different configuration of structural elements sufficient to provide the second pivot mount 130 to support the second movable arm 132 can be provided. In some implementations, e.g., the pivot mount section 134 and the pivot extension member 136 could be formed as a single element 134' (see, e.g., FIG. 8). In some implementations, the pivot mount section can have a stepped section that changes in height from a level of the support 104 to a different level, such as a lower level at the location of the first pivot mount 120 (see, e.g., the pivot mount section 134' in FIG. 8).

The first and second pivot mounts 120, 130 include internal components designed to make the pivoting action smooth, including one or more bearings, and keep the movable arms 122, 132, respectively, securely connected.

Figure 3:
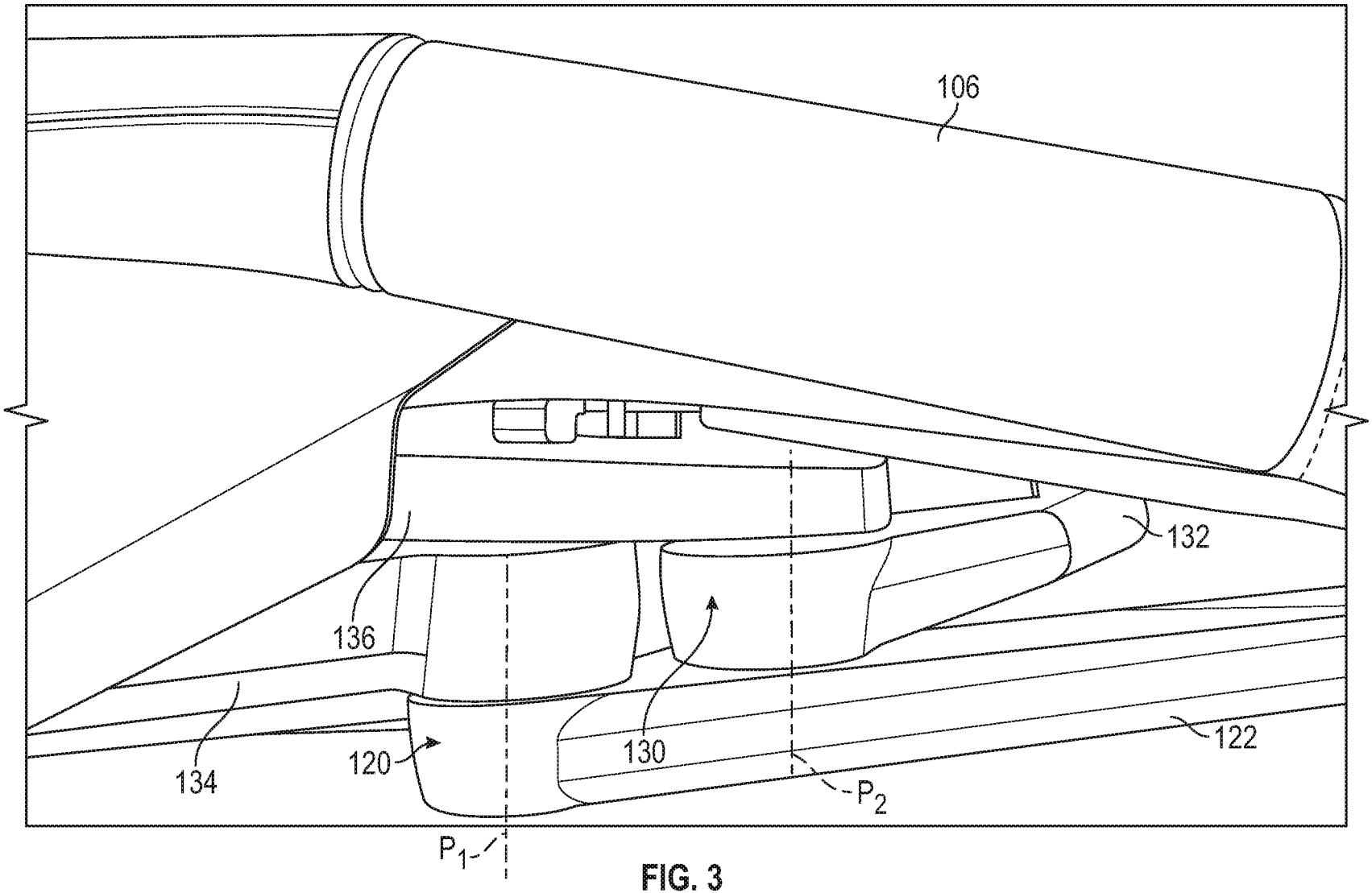
FIGS. 3 and 4 are additional magnified perspective views of the pivot mount of FIG. 1 from different angles.
Figure 4:
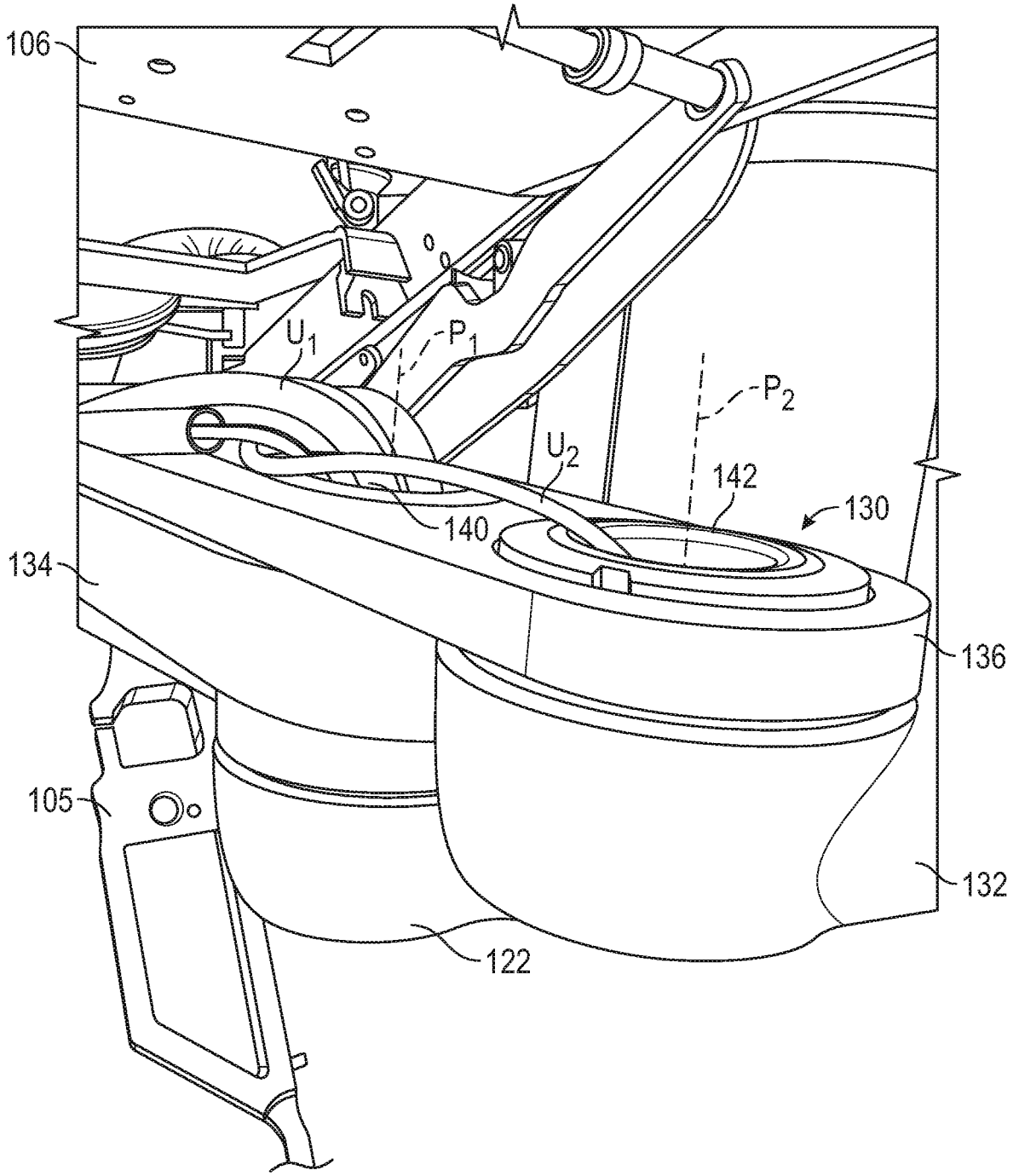

FIG. 3 is another partial perspective view of the tandem pivot mount, showing the first pivot mount 120 to which the first movable arm 122 is coupled and the second pivot mount 130 to which the second movable arm 132 is coupled. As can be seen in FIG. 3, the first and second upright pivot axes $P_1$ and $P_2$, respectively, are located such that they extend to intersect the chair seat 106. Stated differently, the first and second pivot mounts 120, 130 are positioned below the chair seat 106.

Figure 5:
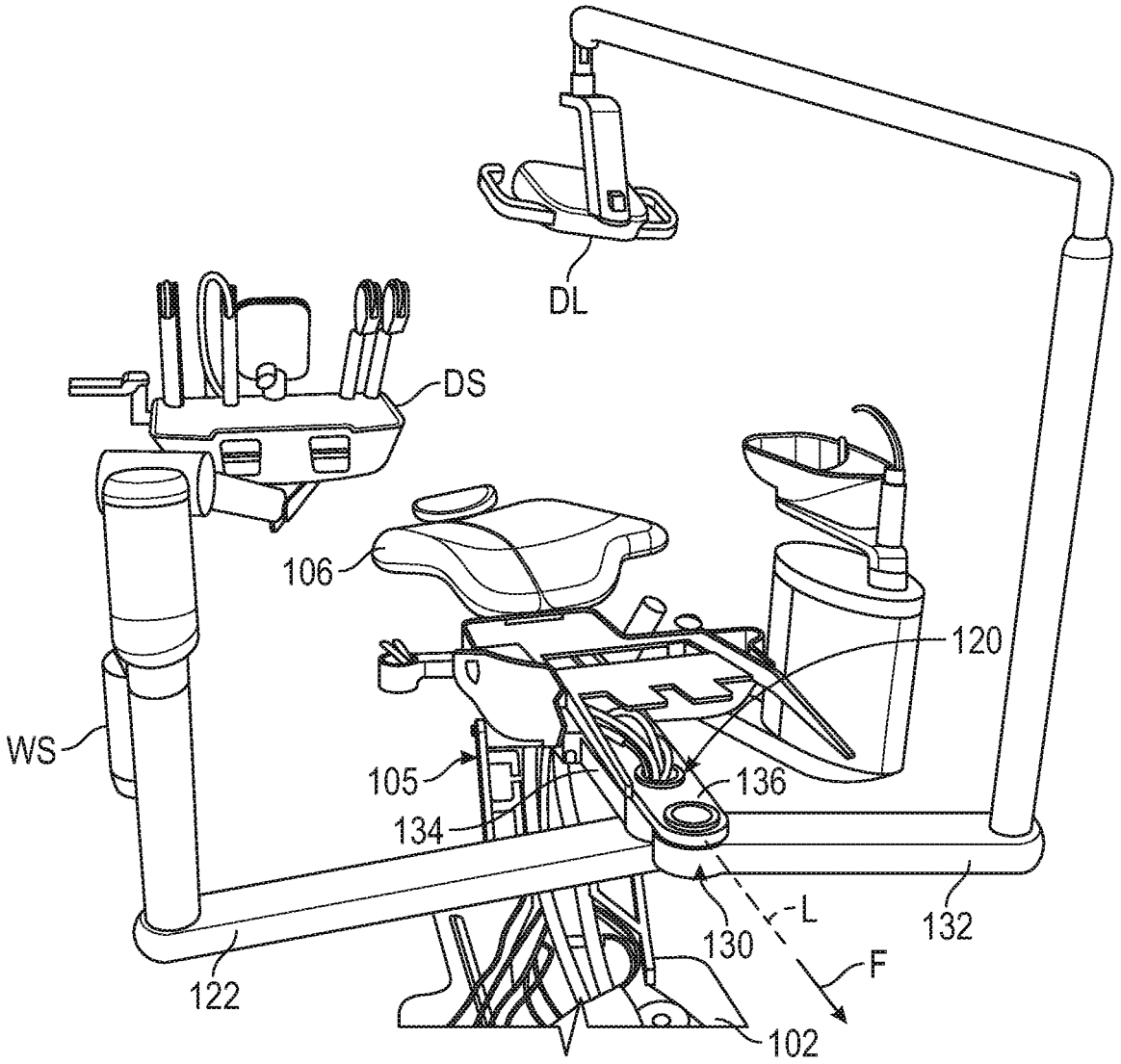
FIG. 5 is a perspective view of the dental chair assembly showing the first and second movable arms supported by the pivot mount and rotated relative to the dental chair to one possible configuration.

FIG. 5 is a perspective view of the dental chair assembly 100 from a different angle, with the chair seat 106 removed for clarity and the first and second movable arms 122, 132 in different positions. Referring to FIGS. 2-5, the first and second pivot mounts can be configured as shown such that the first pivot mount 120 supports the first movable arm 122 having a longer radial length, and the second pivot mount 130 supports the second movable arm 132 having a shorter radial length. In this way, the second movable arm 132 is configured to pass radially inwardly of the first movable arm 122. In other words, the first movable arm 122 swings past the second movable arm 132 to the outside. In other configurations, the second movable arm 132 can be configured to swing to the outside of the first movable arm 122.

The first movable arm 122 can be configured to support a delivery system DS, such as a continental delivery system (shown in FIGS. 1 and 5), a traditional delivery system, or another type of delivery system. The first movable arm 122 can also support various other equipment, such as a water supply container WS, as shown. In the illustrated implementation, the first movable arm 122 is configured to have an adjustable height arm or section (e.g., a flexarm, an arm with a slide lock adjustment, etc.) that allows equipment attached at the distal end, such as the delivery system DS, to be raised and lowered, swung through an arc and retained in place at a desired location (such as, e.g., with a brake or other device), with ease. The second movable arm 132 can be configured to support other equipment, e.g., a dental light DL (FIG. 5). Other alternative configurations are also possible, depending upon the particular operating requirements.

By configuring the first and second movable arms 122, 132 as shown, the dental chair assembly 100 can be quickly changed from a position for use by a left-handed practitioner to an opposite position for use by a right-handed practitioner, and vice versa. In addition, the configuration of the first and second pivot mounts 120, 130, and the locations of the respective pivot axes $P_1$ and $P_2$, are selected to provide for as full of a range of motion about the patient in the chair as is possible while maintaining a compact design that can be used in operatories with small footprints. Within areas next to and over the patient seating area, the delivery system DS on the first movable arm 122 and the light DL on the second movable arm are widely positional with few "dead areas" that cannot be reached.

Another advantage of the tandem or side-by-side mount arrangement is that routing of umbilicals through the first and second pivot mounts 120, 130 and the respective first and second movable arms 122, 132 is made easier. "Umbilicals" is the terminology used herein to describe various cables, conduits, tubings and other long flexible members for conveying fluids, electrical power, data, etc., to and from various devices, including devices located along the first and second movable arms 122, 132. In the illustrated implementation, the first and second movable arms can each have a hollow construction such that umbilicals can be routed internally. Because the first and second pivot mounts 120, 130 are spaced from each other and have separate pivot axes rather than being configured concentrically on a single pivot axis, umbilicals $U_2$ for the second movable arm (one of which is shown in FIG. 2) can be routed from the support, such as from the pivot mount section 134, over the pivot mount extension member 136 and into a second pivot mount opening 142 leading to the hollow interior of the second movable arm 132, separate from umbilicals $U_1$ for the first movable arm. The umbilicals $U_2$ (five of which are shown in FIG. 2) can be routed directly from the support to an opening 140 in the first pivot mount 120 that leads through an opening in the pivot mount section 134 and to a hollow interior of the first movable arm 120.

The tandem pivot mount arrangement also allows for easier retrofitting of a new second pivot mount 130/second movable arm 132, as well as easier servicing of the second movable arm 132. The dental chair assembly 100 can initially be provided with the first pivot mount 120 on the pivot mount section 134 and pivot extension member 136, but without any second movable arm 132. If it is desired at a later time to add the second movable arm 132, then the installation primarily concerns coupling the second movable arm 132 to the second pivot mount 130 and extending the related umbilicals $U_2$ from the support, over the pivot mount section 134 and to the opening 140 as described above, but without requiring the entire disassembly of the first pivot mount 120 and the umbilicals $U_1$.

Figure 6:
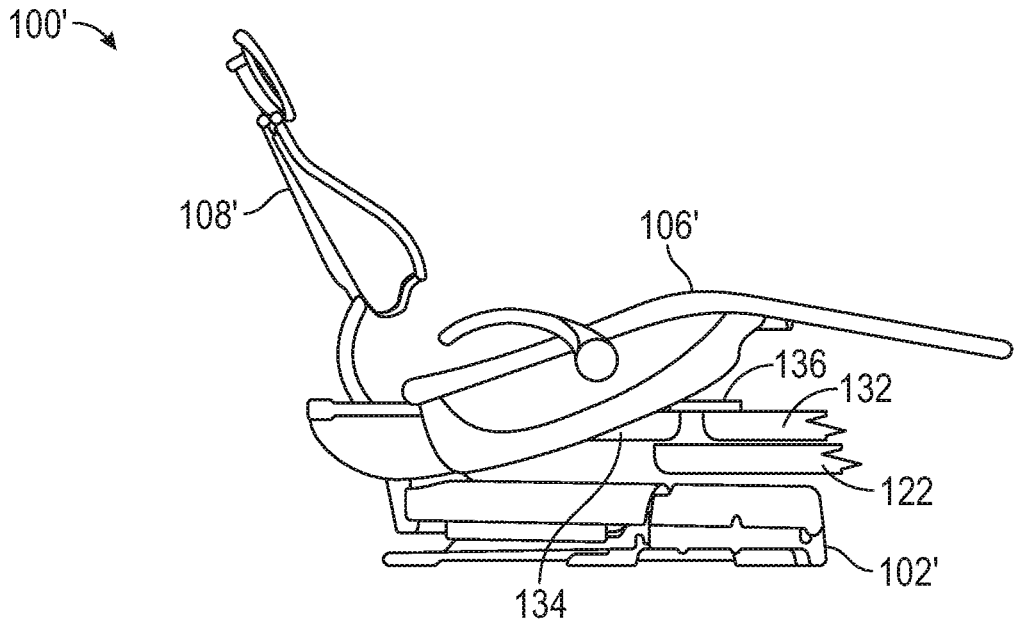
FIGS. 6 and 7 are side elevation views of a dental chair assembly showing the pivot mount and first and second movable arms schematically in a fully lowered position and a fully raised position, respectively.
Figure 7:
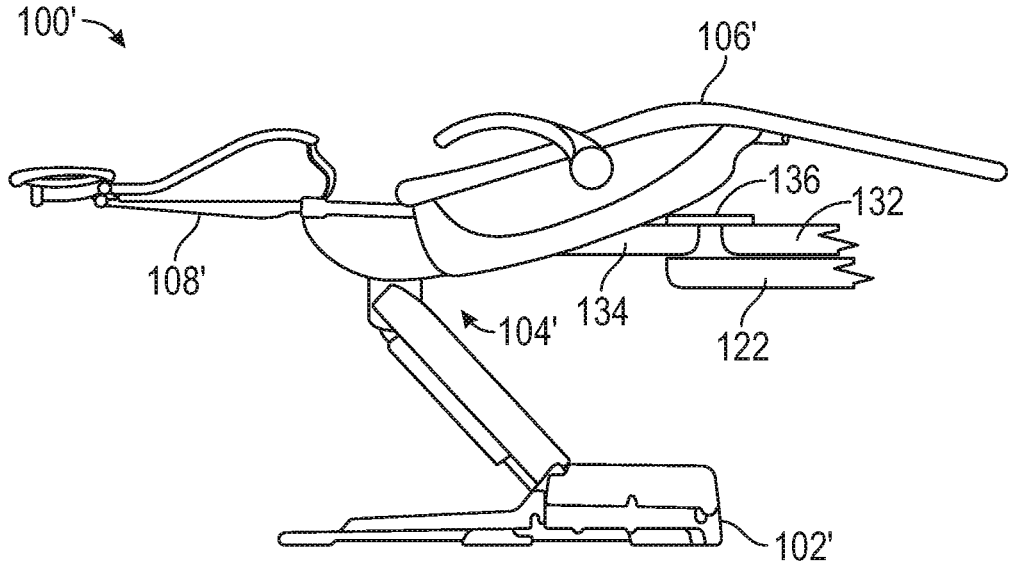

FIGS. 6 and 7 are side elevations of a dental chair assembly 100' having a slightly different base 102', support 104', chair seat 106' and chair back 108', but the same forward pivot mount section 134 and pivot extension member 136. As shown somewhat schematically in FIG. 6, the geometry of the pivot mount section 134 and the pivot mount extension member 136 allows the dental chair to be lowered to a very low elevation, which is easier for patient ingress and egress, without any interference between the first and second movable arms 122, 132 and the base 102'. At the same time, if the dental chair assembly 100' is used in a raised position 100' as shown in FIG. 7, the first and second movable arms 122, 132 are also available for use at the raised elevation.

Although described herein as the dental chair assembly 100, the same or similar equipment as described can be used in procedures other that dentistry, including but not limited to oral surgery and other types of patient treatment where positioning of the patient (and especially the patient's head) within the allowable ranges that can be achieved as shown is helpful.

In view of the many possible embodiments to which the disclosed principles may be applied, it should be recognized that the illustrated embodiments are only preferred examples and should not be taken as limiting in scope. Rather, the scope of protection is defined by the following claims. We therefore claim all that comes within the scope and spirit of these claims.

We claim:

1. A dental chair assembly, comprising:

a base;

a support movably coupled to the base, the support being configured to support a chair seat defined to extend in a forward direction and a chair back positioned rearward of the chair seat, the support having a rear side adjacent the chair back, an opposite forward side and a longitudinal axis extending in the forward direction from the rear side through the forward side;

a first pivot mount positioned along the longitudinal axis forward of the rear side of the support and at a level below the chair seat, wherein the first pivot mount is configured to support at least one movable arm, the first pivot mount defining a first upright pivot axis; and a second pivot mount positioned along the longitudinal axis, spaced forwardly from the first pivot mount and at a level below the chair seat, the second pivot mount being configured to support at least one movable arm and defining a second upright pivot axis parallel to the first upright pivot axis.

2. The dental chair assembly of claim 1, wherein the first pivot mount is defined along a pivot mount section extending forwardly from a main body of the support.

3. The dental chair assembly of claim 1, further comprising a first movable arm mounted to the first pivot mount and a second movable arm mounted to the second pivot mount, and wherein the first movable arm is positioned to swing through an arc at a level below the second movable arm.

4. The dental chair assembly of claim 1, further comprising a pivot mount extension member coupled to the support, and wherein the second pivot mount is defined along the pivot mount extension member.

5. The dental chair assembly of claim 4, wherein the pivot mount extension member is coupled to an upper side of the first pivot mount.

6. The dental chair assembly of claim 4, wherein the second pivot mount is configured to be coupled to the pivot extension member from below.

7. The dental chair assembly of claim 1, wherein at least one of the first pivot mount and the second pivot mount comprises a hollow construction defining an internal umbilical passage through which one or more umbilicals can be routed.

8. The dental chair assembly of claim 3, wherein the first movable arm is configured to swing radially outward relative to the second movable arm.

9. The dental chair assembly of claim 3, wherein the first movable arm is configured to have a longer radius than the second movable arm.

10. The dental chair assembly of claim 3, wherein the second movable arm is configured to support a dental light.

11. The dental chair assembly of claim 3, wherein the first movable arm is configured to support at least a delivery system.

12. The dental chair assembly of claim 4, wherein the pivot mount extension member is coupled to the pivot mount section of the support with fasteners.

13. The dental chair assembly of claim 1, wherein the support comprises a movement device coupled to the base and operable to raise and lower the support.

14. The dental chair assembly of claim 1, wherein the first pivot mount has a first pivot mount opening and the second pivot mount has a second pivot mount opening, and wherein the first pivot mount opening and the second pivot mount opening are positioned at a substantially common level.

15. The dental chair assembly of claim 14, further comprising a pivot mount extension member coupled to the support and defining first and second openings for the first and second pivot mounts.

16. The dental chair assembly of claim 1, wherein the first upright pivot axis and the second upright pivot axis intersect the chair seat.

17. A dental chair assembly, comprising:

a base;

a support movably coupled to the base and having a forward side, a rearward side and a longitudinal axis extending through the forward and rearward sides;

a chair seat coupled to and supported by the support, the chair seat extending longitudinally in a forward direction;

a chair back coupled to and supported by the support, the chair back being positioned rearward of the chair seat;

a first pivot mount positioned along the longitudinal axis forward of the rear side of the support, at a level below the chair seat and defining a first upright pivot axis;

a second pivot mount positioned along the longitudinal axis, at a level below the chair seat and spaced forwardly from the first pivot mount, the second pivot mount defining a second upright pivot axis parallel to the first upright pivot axis;

a first movable arm coupled to the first pivot mount; and a second movable arm coupled to the second pivot mount.

18. The dental chair assembly of claim 17, wherein the first movable arm is positioned to swing through an arc about the first pivot axis at a level below the second movable arm.

19. The dental chair assembly of claim 17, wherein the first movable arm is configured to have a longer radius than the second movable arm such that the first movable arm can be swung radially outward of the second moveable arm.

20. The dental chair assembly of claim 17, wherein the first and second movable arms each have a length greater than the distances separating the first pivot axis from a distal end of the chair seat and from the second pivot axis and the distal end of the chair seat, respectively.

* * * * *